US008737626B2

(12) United States Patent
Kawashima

(10) Patent No.: US 8,737,626 B2
(45) Date of Patent: May 27, 2014

(54) AUDIO SIGNAL DECODING DEVICE AND METHOD OF BALANCE ADJUSTMENT

(75) Inventor: Takuya Kawashima, Ishikawa (JP)

(73) Assignee: Panasonic Corporation, Osaka (JP)

( * ) Notice: Subject to any disclaimer, the term of this patent is extended or adjusted under 35 U.S.C. 154(b) by 534 days.

(21) Appl. No.: 13/144,041

(22) PCT Filed: Jan. 12, 2010

(86) PCT No.: PCT/JP2010/000112

§ 371 (c)(1),
(2), (4) Date: Jul. 11, 2011

(87) PCT Pub. No.: WO2010/082471

PCT Pub. Date: Jul. 22, 2010

(65) Prior Publication Data

US 2011/0268280 A1 Nov. 3, 2011

(30) Foreign Application Priority Data

Jan. 13, 2009 (JP) ..... 2009-004840
Mar. 26, 2009 (JP) ..... 2009-076752

(51) Int. Cl.

| | |
|---|---|
| ***H04S 5/00*** | (2006.01) |
| *G10L 19/00* | (2013.01) |
| *G10L 19/005* | (2013.01) |
| *G10L 19/008* | (2013.01) |

(52) U.S. Cl.
USPC ..... 381/17; 381/1; 700/94

(58) Field of Classification Search
CPC . G10L 19/005; G10L 19/008; G10L 19/0204; G10L 19/04; H04L 65/607; H04S 2420/03
USPC ..... 381/1, 17–22; 700/94; 704/200–201, 704/500
See application file for complete search history.

(56) References Cited

U.S. PATENT DOCUMENTS

2004/0039464 A1* 2/2004 Virolainen et al. ..... 700/94
2005/0053242 A1* 3/2005 Henn et al. ..... 381/22

(Continued)

FOREIGN PATENT DOCUMENTS

JP 07/336310 12/1995
JP 2001/296894 10/2001

(Continued)

OTHER PUBLICATIONS

Extended European Search Report dated Nov. 12, 2012.

(Continued)

*Primary Examiner* — Duc Nguyen
*Assistant Examiner* — Alexander Eljaiek
(74) *Attorney, Agent, or Firm* — Dickinson Wright PLLC

(57) ABSTRACT

Disclosed is an audio signal decoding device and a method of balance adjustment that reduces a fluctuation of a decoded signal orientation and maintains a stereo perception. An interchannel correlation computation unit (224) computes a correlation between a left channel decoded stereo signal and a right channel decoded stereo signal, and if the interchannel correlation is low, a peak detection unit (225) uses a peak component of a decoded monaural signal of the current frame and a peak component of either a left or a right channel of the preceding frame to detect a peak component with a high temporal correlation. The peak detection unit (225) combines and outputs, from among the frequencies of the detected peak components, a peak frequency of a frame n−1 and a peak frequency of a frame n. A peak balance coefficient computation unit (226) computes, from the peak frequency of the frame n−1, a balance parameter that is used in converting a peak frequency component of the monaural signal to stereo.

5 Claims, 8 Drawing Sheets

(56) References Cited

U.S. PATENT DOCUMENTS

| | | | | |
|---|---|---|---|---|
| 2005/0177360 | A1 | 8/2005 | Schuijers | |
| 2008/0056511 | A1 | 3/2008 | Zhang | |
| 2008/0249766 | A1 * | 10/2008 | Ehara | 704/203 |

FOREIGN PATENT DOCUMENTS

| | | |
|---|---|---|
| JP | 2004/535145 | 11/2004 |
| JP | 2005/533271 | 11/2005 |
| JP | 2006/087130 | 3/2006 |
| JP | 2007/316254 | 12/2007 |
| WO | 03/007656 | 1/2003 |
| WO | 2004/008806 | 1/2004 |
| WO | 2005/101371 | 10/2005 |
| WO | 2005/106848 | 11/2005 |

OTHER PUBLICATIONS

European Broadcasting Union, "Radio Broadcasting Systems; Digital Audio Broadcasting (DAB) to mobile, portable and fixed receivers," Final draft, ETSI EN 300 401, V1.4.1, Jan. 2006, pp. 1-197.

International Search Report dated Feb. 23, 2010.

M. Karjaiainen, et al., "Localization of Amplitude-Panned Virtual Sources I: Stereographic Panning," Journal of the Audio Engineering Society, Sep. 2001, pp. 739-752.

I. Burnett, et al., "Principles and Analysis of the Squeezing Approach to Low Bit Rate Spatial Audio Coding," IEEE ICASSP2007, Apr. 2007, pp. I-13-I-16.

* cited by examiner

AUDIO SIGNAL DECODING DEVICE AND METHOD OF BALANCE ADJUSTMENT

TECHNICAL FIELD

The present invention relates to an audio signal decoding apparatus and a method of balance adjustment.

BACKGROUND ART

As a system to encode a stereo audio signal at a low bit rate, an intensity stereo system is known. In the intensity stereo system, an L channel signal (left channel signal) and an R channel signal (right channel signal) are generated by multiplying a monaural signal by a scaling factor. This type of technology is referred also as an amplitude panning.

The most basic technology of the amplitude panning multiplies a monaural signal in a time domain by a gain factor for the amplitude panning (panning gain factor) to calculate the L channel signal and the R channel signal (e.g. see non patent literature 1). Further, as another technology, the monaural signal may be multiplied by the panning gain factor to calculate the L channel signal and the R channel signal for each of frequency components (or each of frequency groups) in a frequency domain (e.g. see non patent literature 2).

When the panning gain factor is used as an encoding parameter of a parametric stereo, a scalable encoding of a stereo signal (monaural-stereo scalable encoding) can be realized (e.g. see patent literature 1 and patent literature 2). The panning gain factor is explained as a balance parameter in patent literature 1, and is explained as an ILD (level difference) in patent literature 2, respectively.

Note that the balance parameters are defined as a gain factor to multiply with the monaural signal upon converting the monaural signal to the stereo signal, and this corresponds to the panning gain factor (gain factor) in amplitude panning.

CITATION LIST

Patent Literature

PTL 1
Published Japanese Translation No. 2004-535145 of the PCT International Publication
PTL 2
Published. Japanese Translation No. 2005-533271 of the PCT International Publication Non Patent Literature
NPL 1
V. Pulkki and M. Karjalainen, "Localization of amplitude-panned virtual sources I: Stereophonic panning", Journal of the Audio Engineering Society, Vol. 49, No. 9, September 2001, pp. 739-752
NPL 2
B. Cheng, C. Ritz and I. Burnett, "Principles and analysis of the squeezing approach to low bit rate spatial audio coding", proc. IEEE ICASSP2007, pp. I-13-I-16, April 2007

SUMMARY OF INVENTION

Technical Problem

However, in monaural-stereo scalable encoding, the stereo encoded data may be lost on a transmission channel, and may not be received by a decoding apparatus side. Further, an error may occur in the stereo encoded data on the transmission channel, and the stereo encoded data may be discarded on the decoding apparatus side. In such a case, since the balance parameter (panning gain factor) included in the stereo encoded data cannot be used, in the decoding apparatus, the stereo and the monaural are switched, and a localization of a decoded audio signal is fluctuated. As a result, the quality of a stereo audio signal becomes deteriorated.

It is therefore an object of the present invention to provide an audio signal decoding apparatus and a method of balance adjustment that suppress the fluctuation of localization of a decoded signal and maintains a stereo perception.

Solution to Problem

An audio signal decoding apparatus of the present invention employs a configuration of comprising: a peak detecting section that, when a peak frequency component existing in one of a left channel and a right channel of a previous frame and a peak frequency component of a monaural signal of a present frame are in a matching range, extracts a set of a frequency of the peak frequency component of the previous frame and a frequency of a peak frequency component of the monaural signal of the present frame corresponding to that frequency; a peak balance factor calculating section that calculates, from the peak frequency component of the previous frame, a balance parameter for stereo-converting the peak frequency component of the monaural signal; and a multiplying section that multiplies the peak frequency component of the monaural signal of the present frame by the calculated balance parameter to perform stereo conversion.

A method of adjusting a balance of the present invention is configured to comprise: a peak detecting step of extracting, when a peak frequency component existing in one of a left channel and a right channel of a previous frame and a peak frequency component of a monaural signal of a present frame are in a matching range, a set of a frequency of the peak frequency component of the previous frame and a frequency of a peak frequency component of the monaural signal of the present frame corresponding to that frequency; a peak balance factor calculating step of calculating, from the peak frequency component of the previous frame, a balance parameter for stereo-converting the peak frequency component of the monaural signal; and a multiplying step of multiplying the peak frequency component of the monaural signal of the present frame by the calculated balance parameter to perform stereo conversion.

Advantageous Effects of Invention

According to the present invention, the fluctuation of localization of a decoded signal can be suppressed and the stereo perception can be maintained.

DESCRIPTION OF EMBODIMENTS

Hereinafter, embodiments of the present invention will be explained with reference to the drawings.

Embodiment 1

Figure 1:
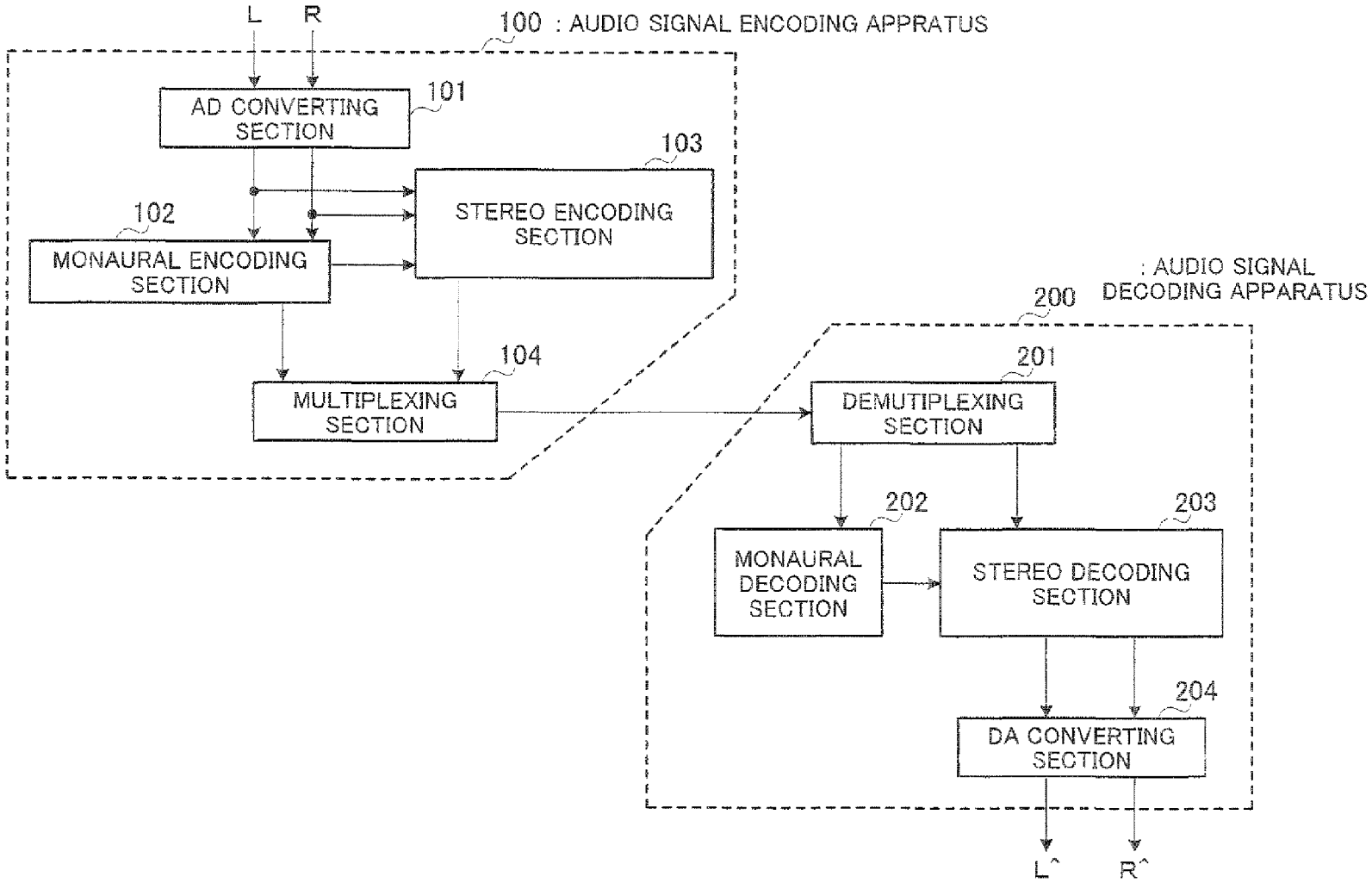
FIG. 1 is a block diagram showing configurations of an audio signal encoding apparatus and an audio signal decoding apparatus of an embodiment of the present invention.

FIG. 1 is a block diagram showing configurations of audio signal encoding apparatus 100 and audio signal decoding apparatus 200 of an embodiment of the present invention. As shown in FIG. 1, audio signal encoding apparatus 100 comprises AD conversion section 101, monaural encoding section 102, stereo encoding section 103, and multiplexing section 104.

AD conversion section 101 inputs analog stereo signals (L channel signal: L, R channel signal: R), converts these analog stereo signals to digital stereo signals, and outputs the same to monaural encoding section 102 and stereo encoding section 103.

Monaural encoding section 102 performs a down-mixing process on the digital stereo signals outputted from AD conversion section 101 and converts the same into a monaural signal, and encodes the monaural signal. An encoded result (monaural encoded data) is outputted to multiplexing section 104. Further, monaural encoding section 102 outputs information (monaural encoded information) obtained from the encoding process to stereo encoding section 103.

Stereo encoding section 103 parametrically encodes the digital stereo signals outputted from AD conversion section 101 using the monaural encoded information outputted from monaural encoding section 102, and outputs an encoded result (stereo encoded data) including a balance parameter to multiplexing section 104.

Multiplexing section 104 multiplexes the monaural encoded data outputted from monaural encoding section 102 and the stereo encoded data outputted from stereo encoding section 103, and sends out a multiplexed result (multiplexed data) to demultiplexing section 201 of audio signal decoding apparatus 200.

Note that, a transmission channel such as a telephone line, a packet network, etc. exists between multiplexing section 104 and demultiplexing section 201, and the multiplexed data outputted from multiplexing section 104 is outputted to the transmission channel after processes such as packetizing are performed as needed.

On the other hand, as shown in FIG. 1, audio signal decoding apparatus 200 comprises demultiplexing section 201, monaural decoding section 202, stereo decoding section 203, and DA conversion section 204.

Demultiplexing section 201 receives the multiplexed data sent out from audio signal encoding apparatus 100, separates the multiplexed data into monaural encoded data and stereo encoded data, outputs the monaural encoded data to monaural decoding section 202, and outputs the stereo encoded data to stereo decoding section 203.

Monaural decoding section 202 decodes the monaural encoded data outputted from de multiplexing section 201 to a monaural signal, and outputs the decoded monaural signal (decoded monaural signal) to stereo decoding section 203. Further, monaural decoding section 202 outputs information (monaural decoded information) obtained by the decoding process to stereo decoding section 203.

Note that, monaural decoding section 202 may output the decoded monaural signal to stereo decoding section 203 as a stereo signal to which an up-mixing process has been performed. When the up-mixing process is not performed in monaural decoding section 202, information necessary for the up-mixing process is outputted from monaural decoding section 202 to stereo decoding section 203, and the up-mixing process may be performed on the decoded monaural signal in stereo decoding section 203.

Here, a typical case is that no special information is necessary for the up-mixing process. However, when the down-mixing process for adjusting a phase between the L channel and the R channel is to be performed, phase difference information is considered as information necessary for the up-mixing process. Further, when the down-mixing process for adjusting the amplitude level between the L channel and the R channel is to be performed, a scaling factor for adjusting the amplitude level, etc. is considered as information necessary for the up-mixing process.

Stereo decoding section 203 decodes the decoded monaural signal outputted from monaural decoding section 202 to digital stereo signals, and outputs the digital stereo signals to DA conversion section 204 by using the stereo encoded data outputted from demultiplexing section 201 and the monaural decoded information outputted from monaural decoding section 202.

DA conversion section 204 converts the digital stereo signals outputted from stereo decoding section 203 into analog stereo signals, and outputs the analog stereo signals as decoded stereo signals (L channel decoded signal: L^ signal, R channel decoded signal: R^ signal).

Figure 2:
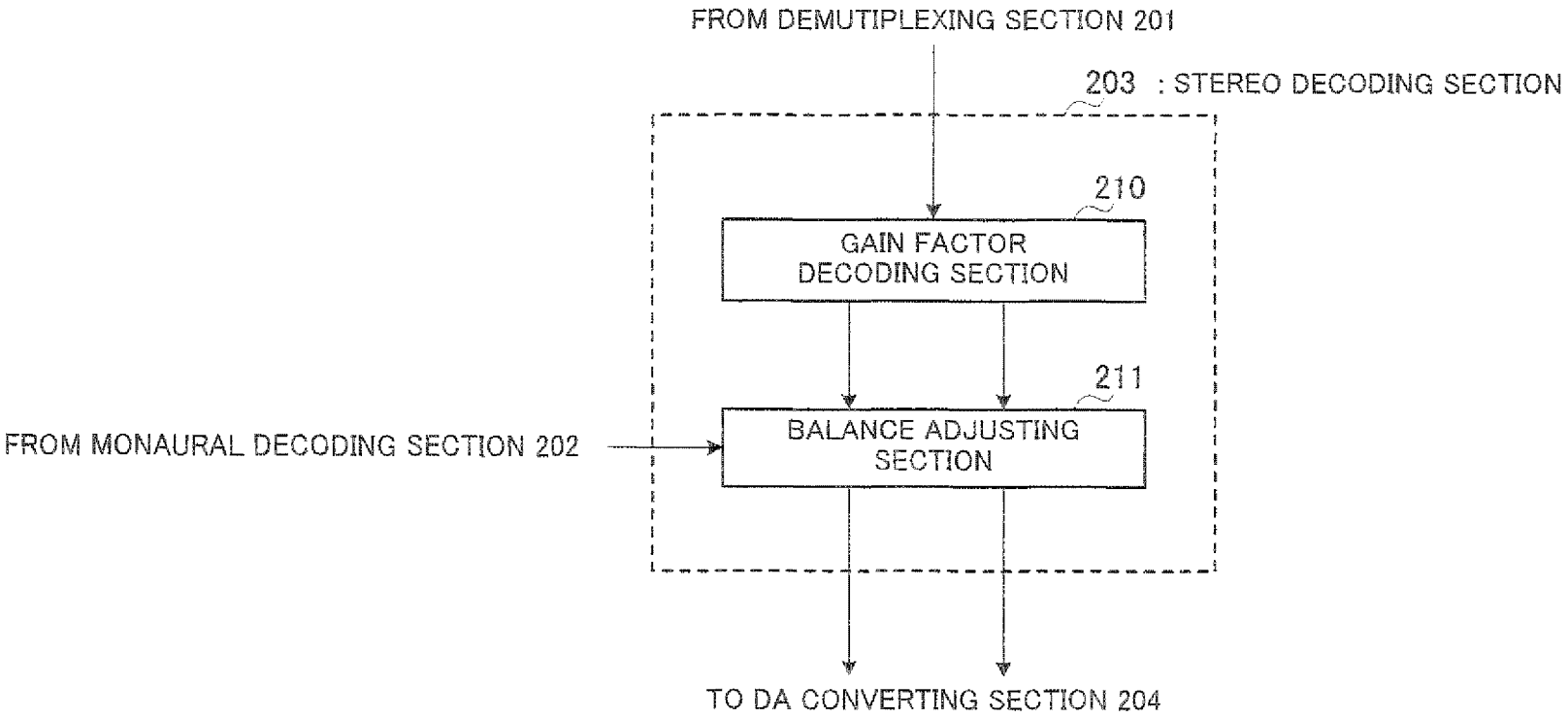
FIG. 2 is a block diagram showing an internal configuration of a stereo decoding section shown in FIG. 1.

FIG. 2 is a block diagram showing an internal configuration of stereo decoding section 203 shown in FIG. 1. In the present embodiment, the stereo signals are expressed parametrically simply by a balance adjusting process. As shown in FIG. 2, stereo decoding section 203 comprises gain factor decoding section 210 and balance adjusting section 211.

Gain factor decoding section 210 decodes balance parameters from the stereo encoded data outputted from demultiplexing section 201, and outputs the balance parameters to balance adjusting section 211. FIG. 2 shows an example in which a balance parameter for the L channel and a balance parameter for the R channel are respectively outputted from gain factor decoding section 210.

Balance adjusting section 211 performs the balance adjusting process on the decoded monaural signal outputted from monaural decoding section 202 by using the balance parameters outputted from gain factor decoding section 210. That is, balance adjusting section 211 multiplies the respective balance parameters with the decoded monaural signal outputted from monaural decoding section 202, and generates the L channel decoded signal and the R channel decoded signal. Here, in assuming that the decoded monaural signal is a signal within a frequency domain (e.g. PET coefficient, MDCT coefficient, etc.), the respective balance parameters are multiplied with a decoded monaural signal for each of the frequencies.

In a typical audio signal decoding apparatus, a process on the decoded monaural signal is performed for each of a plurality of sub-bands. Further, widths of the respective sub-bands are typically set to become larger as the frequency increases. Accordingly, in the present embodiment, one balance parameter is decoded for one sub-band, and a common balance parameter is used for the respective frequency components in the respective sub-bands. Note that the decoded monaural signal can be treated as a signal in a time domain.

Figure 3:
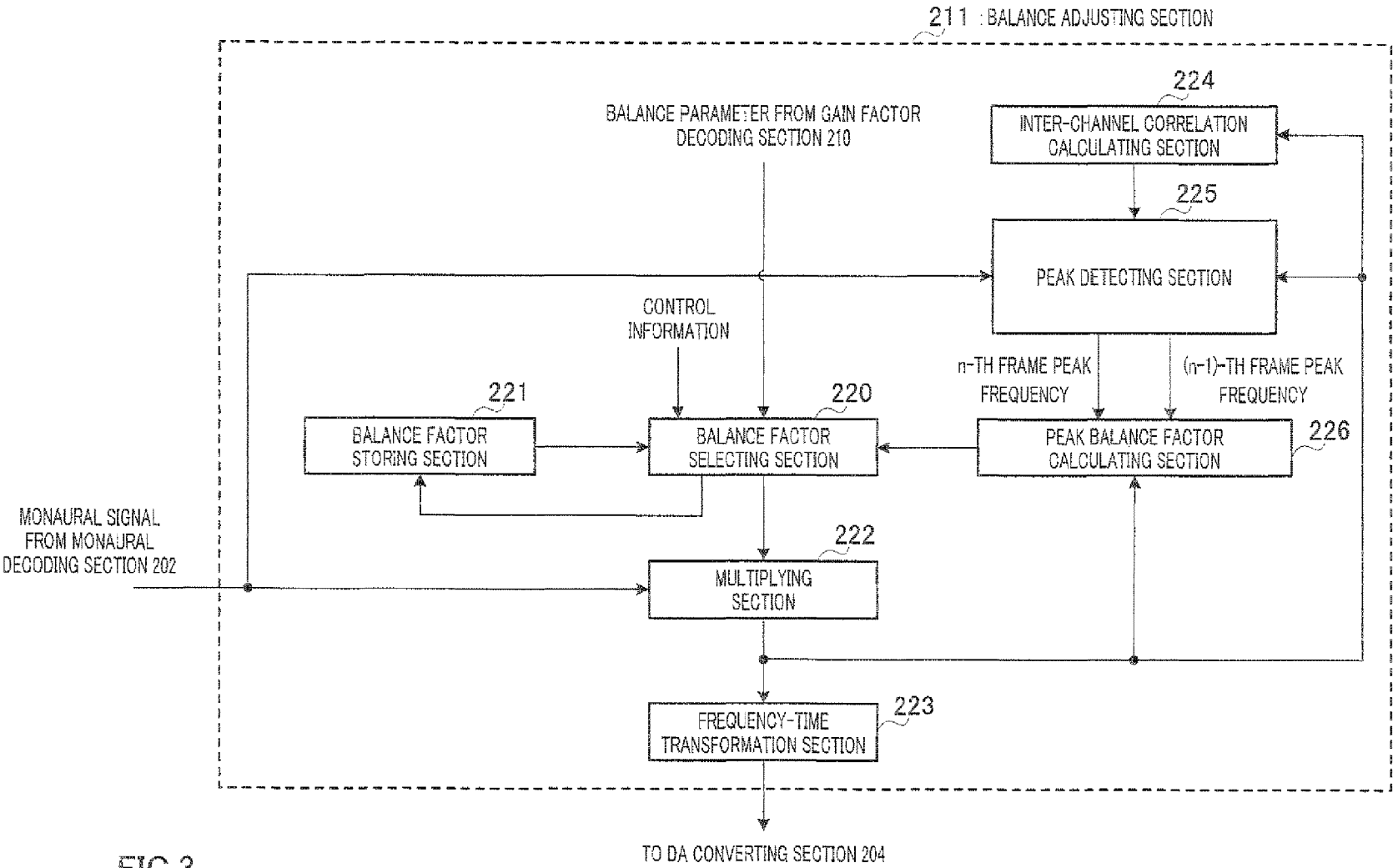
FIG. 3 is a block diagram of an internal configuration of a balance adjusting section shown in FIG. 2.

FIG. 3 is block diagram of an internal configuration of balance adjusting section 211 shown in FIG. 2. As shown in FIG. 3, balance adjusting section 211 comprises balance factor selecting section 220, balance factor storing section 221, multiplying section 222, frequency-time transformation section 223, inter-channel correlation calculating section 224, peak detecting section 225, and peak balance factor calculating section 226.

Here, the balance parameters outputted from gain factor decoding section 210 are inputted to multiplying section 222 via balance factor selecting section 220. It should be noted that as a case in which the balance parameters are not inputted from gain factor decoding section 210 to balance factor selecting section 220, there may be a case in which the stereo encoded data had been lost on the transmission channel and thus had not been received by audio signal decoding apparatus 200, or a case in which an error had been detected in the stereo encoded data received by audio signal decoding apparatus 200 and thus the stereo encoded data had been discarded, etc. That is, a case of having no input of the balance parameters from gain factor decoding section 210 corresponds to the case in which the balance parameters included in the stereo encoded data cannot be utilized.

Consequently, balance factor selecting section 220 inputs a control signal indicating whether or not the balance parameters included in the stereo encoded data can be utilized, and switches a connection state between multiplying section 222 and one of gain factor decoding section 210, balance factor storing section 221, and peak balance factor calculating section 226 based on this control signal. Note that operational details of balance factor selecting section 220 will be described later.

Balance factor storing section 221 stores, for each of the frames, the balance parameters outputted from balance factor selecting section 220, and outputs the stored balance parameters at a timing of processing a subsequent frame to balance factor selecting section 220.

Multiplying section 222 multiplies each of the balance parameter for the L channel and the balance parameter for the R channel that are outputted from balance factor selecting section 220 with the decoded monaural signal outputted from monaural decoding section 202 (monaural signal that is a frequency domain parameter), and outputs a multiplied result (stereo signal that is a frequency domain parameter) for each of the L channel and the R channel to frequency-time transformation section 223, inter-channel correlation calculating section 224, peak detecting section 225, and peak balance factor calculating section 226. As aforementioned, multiplying section 222 performs the balance adjusting process on the monaural signal.

Frequency-time transformation section 223 transforms each of the decoded stereo signals for the L channel and the R channel outputted from multiplying section 222 into time signals, and outputs the same as digital stereo signals for the L channel and the R channel respectively to DA conversion section 204.

Inter-channel correlation calculating section 224 calculates a correlation of the decoded stereo signal for the L channel and the decoded stereo signal for the R channel that had been outputted from multiplying section 222, and outputs the calculated correlation information to peak detecting section 225. For example, the correlation is calculated by below equation 1.

(Equation 1)

$$c(n-1) = \frac{\sum_{i=1}^{N} \{|fL(n-1, i)| - |fR(n-1, i)|\}^2}{\{fL(n-1, i) + fR(n-1, i)\}^2} \quad [1]$$

Here, c(n−1) represents a correlation of a decoded stereo signal of an (n−1)-th frame. In assuming that a present frame in which the stereo encoded data had been lost is n-th frame, the (n−1)-th frame becomes a previous frame. fL(n−1, i) represents the amplitude of frequency i of the decoded signal in the frequency domain of the L channel of the (n−1)-th frame. fR(n−1, i) represents the amplitude of frequency i of the decoded signal in the frequency domain of the R channel of the (n−1)-th frame. Inter-channel correlation calculating section 224 outputs the correlation information i c(n−1)=1 for the correlation being small e.g. when c(n−1) is larger than a predetermined α. When c(n−1) is smaller than α, the correlation information ic(n−1)=0 is outputted for the correlation being large.

Peak detecting section 225 obtains the decoded monaural signal outputted from monaural decoding section 202, the L channel stereo frequency signal and the R channel stereo frequency signal outputted from multiplying section 222 and the correlation information outputted from inter-channel correlation calculating section 224. Peak detecting section 225 detects a peak component having a high time correlation between a peak component of the decoded monaural signal of the present frame and a peak component of one of the L, R channels of the previous channel when it is notified by the correlation information that the correlation between the channels is low (ic(n−1)=1). Among the frequencies of the detected peak components, peak detecting section 225 outputs the frequency of the peak component of the (n−1)-th frame to peak balance factor calculating section 226 as an n−1)-th frame peak frequency, and outputs the frequency of the peak component of the n-th frame to peak balance factor calculating section 226 as an n-th frame peak frequency. Further, when it is notified by the correlation information that the correlation between the channels is high (ic(n−1)=0), peak detecting section 225 does not perform the peak detection and does not output anything.

Peak balance factor calculating section 226 obtains the L channel stereo frequency signal and the R channel stereo frequency signal that are outputted from multiplying section 222, and the (n−1)-th frame peak frequency and the n-th frame peak frequency outputted from peak detecting section 225. In assuming that the n-th frame peak frequency is i and the (n−1)-th frame peak frequency is j, the peak components are expressed as fL(n−1, j) and fR(n−1, j). At this occasion, the balance parameters for frequency j are calculated from the L channel stereo frequency signal and the R channel stereo frequency signal, and the same are outputted to balance factor selecting section 220 as peak balance parameters for the frequency j.

Here, one example of a balance parameter calculation for the frequency j is shown below. In this example, the balance parameters are calculated by L/(L+R). It should be noted that by calculating the balance parameters after having smoothed the peak components in a frequency axis direction, the balance parameters do not indicate an abnormal value, and can stably be utilized. Specifically, they are calculated as in below equation 2 and equation 3.

(Equation 2)

$$WL(i) = \frac{\sum_{k=j-1}^{j+1} |fL(n-1,k)|}{\sum_{k=j-i}^{j+1} (|fL(n-1,k)| + |fR(n-1,k)|)} \quad [2]$$

(Equation 3)

$$WR(i) = \frac{\sum_{k=j-1}^{j+1} |fR(n-1,k)|}{\sum_{k=j-1}^{j+1} (|fL(n-1,k)| + |fR(n-1,k)|)} \quad [3]$$

Note that i represents the n-th frame peak frequency, and j represents the (n−1)-th frame peak frequency. WL is assumed as a peak balance parameter for frequency i of the L channel, and WR is assumed as a peak balance parameter for frequency i of the R channel. Here, although a three-sample moving average with the peak frequency j as a center thereof is calculated as the smoothing in the frequency axis direction, the balance parameters may be calculated by other methods having the same effect.

When the balance parameters are outputted from gain factor decoding section 210 (a case where utilization of the balance parameters included in the stereo encoded data is possible), balance factor selecting section 220 selects the aforementioned balance parameters. Further, when the balance parameters are not outputted from gain factor decoding section 210 (a case where the utilization of the balance parameters included in the stereo encoded data is impossible), balance factor selecting section 220 selects the balance parameters outputted from balance factor storing section 221 and peak balance factor calculating section 226. The selected balance parameters are outputted to multiplying section 222. Further, as an output to balance factor storing section 221, when the balance parameters are outputted from gain factor decoding section 210, the aforementioned balance parameters are outputted, and when the balance parameters are not outputted from gain factor decoding section 210, the balance parameters outputted from balance factor storing section 221 are outputted.

Note that balance factor selecting section 220 selects balance parameters from peak balance factor calculating section 226 when the balance parameters are outputted from peak balance factor calculating section 226, and selects balance parameters from balance factor storing section 221 when the balance parameters are not outputted from peak balance factor calculating section 226. That is, when only WL(i) and WR(i) are outputted from peak balance factor calculating section 226, the balance parameters from peak balance factor calculating section 226 are used for the frequency i, and the balance parameters from balance factor storing section 221 are used for other than the frequency i.

Figure 4:
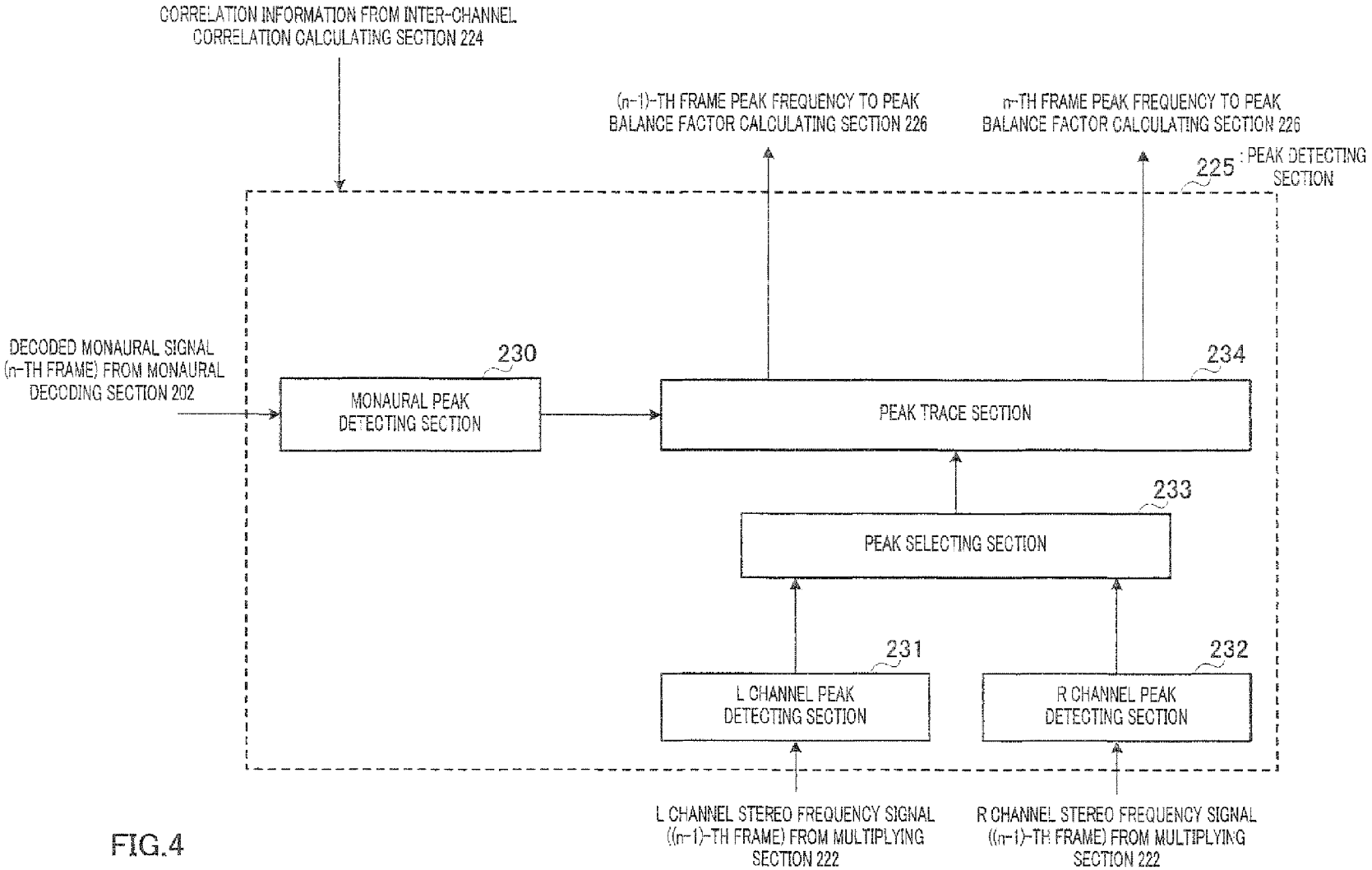
FIG. 4 is a block diagram of an internal configuration of a peak detecting section shown in FIG. 3.

FIG. 4 is a block diagram of an internal configuration of peak detecting section 225 shown in FIG. 3. As shown in FIG. 4, peak detecting section 225 comprises monaural peak detecting section 230, L channel peak detecting section 231, R channel peak detecting section 232, peak selecting section 233, and peak trace section 234.

Monaural peak detecting section 230 detects peak components from the decoded monaural signal of the n-th frame outputted from monaural decoding section 202, and outputs detected peak components to peak trace section 234. As a method for detecting the peak components, for example, an absolute value of the decoded monaural signal is taken and absolute value components having larger amplitude than a predetermined constant βM are detected, thereby the peak components may be detected from the decoded monaural signal.

L channel peak detecting section 231 detects peak components from the L channel stereo frequency signal of the (n−1)-th frame outputted from multiplying section 222, and outputs the detected peak components to peak selecting section 233. As a method for detecting the peak components, for example, an absolute value of the L channel stereo frequency signal is taken and absolute value components having larger amplitude than a predetermined constant βL are detected, thereby the peak components may be detected from the L channel stereo frequency signal.

R channel peak detecting section 232 detects peak components from the R channel stereo frequency signal of the (n−1)-th frame outputted from multiplying section 222, and outputs the detected peak components to peak selecting section 233. As a method for detecting the peak components, for example, an absolute value of the R channel stereo frequency signal is taken and absolute value components having larger amplitude than a predetermined constant R are detected, thereby the peak components may be detected from the L channel stereo frequency signal.

Peak selecting section 233 selects peak components satisfying a condition from among the L channel peak components outputted from L channel peak detecting section 231 and the R channel peak components outputted from R channel peak detecting section 232, and outputs selected peak information including the selected peak components and channels to peak trace section 234.

Hereinafter, the peak selection by peak selecting section 233 will be explained in detail. When the peak components of the L channel and the R channel are inputted, peak selecting section 233 arranges the inputted peak components of the both channels from the low frequency side to the high frequency side. Here, the inputted peak components (fL(n−1, j), fR(n−1, j), etc.) are expressed such as fLR(n−1, k, c). fLR represents the amplitude, k represents the frequency, and c represents the L channel (left) or the R channel (right).

Subsequently, peak selecting section 233 checks the peak components that are selected from the low frequency side. When the peak components to be checked are fLR(n−1, k1, c1), it is checked whether or not a peak exists within the frequency range $k1-\gamma<k1<k1+\gamma$ (note that γ is a predetermined constant). In a case of no existence, fLR(n−1, k1, c1) is outputted. When a peak component is present in the frequency range of $k1-\gamma<k1<k1+\gamma$, only one peak component is selected in that range. For example, when a plurality of peak components is within the above range, a peak component having an amplitude with the largest absolute value amplitude may be selected from among the plurality of peak components. At this occasion, the peak components that were unselected may be excluded from objects of operation. After ending the selection of one peak component, next, a selection process is performed for all of the peak components toward the high frequency side except for the already selected peak component.

Peak trace section 234 determines whether the peak has a high temporal continuity between the selected peak information outputted from peak selecting section 233 and the peak components from the monaural signal outputted from monaural peak detecting section 230, and when the temporal continuity is determined as being high, outputs to peak balance factor calculating section 226 the selected peak information as the (n−1)-th frame peak frequency and the peak components from the monaural signal as the n-th frame peak frequency.

Here, an example of a method for detecting peak components having high continuity will be given. From among the peak components from monaural peak detecting section 230, a peak component fM(n, i) with the lowest frequency is selected. It is assumed that n represents the n-th frame, and i represents the frequency in the n-th frame. Next, from among the selected peak information fLR(n−1, j, c) outputted from peak selecting section 233, selected peak information located near fM(n, i) is detected. It is assumed that j represents the frequency j of the frequency signal of the L channel or the R channel of the (n−1)-th frame. For example, if fLR(n−1, j, c) exists in $i-\eta \le j \le i+\eta$ (note that η is a predetermined value), fM(n, i) and fLR(n−1, j, c) are selected as peak components having high continuity. When a plurality of fLRs are present in that range, one with the largest absolute value amplitude may be selected, or a peak component that is closer to i may be selected. After ending the detection of the peak components having high continuity with fM(n, i), similar process is performed for a peak component fM(n, i2) of the second highest frequency, and the detection of the peak components having high continuity is performed for all of the peak components outputted from monaural peak detecting section 230. Here, it is assumed i2>i. As a result, peak components having high continuity are detected between the peak components from the n-th frame monaural signal and the peak components from both L and R channels of the (n−1)-th frame. Due to this, the (n−1)-th frame peak frequency and the n-th frame peak frequency are outputted as a set for each peak.

According to the aforementioned configuration and operation, peak detecting section 225 detects the peak components with high temporal continuity, and outputs the detected peak frequencies.

As above, according to embodiment 1, by detecting peak components with high correlation in a time axis direction, and calculating balance parameters with high frequency resolution for the detected peaks thereby to use the same in concealment, an audio signal decoding apparatus in which a high-quality stereo error concealment in which a sound leakage and an unnatural shifting perception of a sound image are suppressed can be realized.

Embodiment 2

When stereo encoded data is lost over a long period or is lost very often, when a stereo conversion is continued by having balance parameters from the past extrapolated to the lost stereo encoded data, this may become a cause of an noise, or may generate a sense of discomfort in an acoustic perception by energy being unnaturally accumulated in one of the channels. Therefore, when the stereo encoded data is lost over a long period as aforementioned, a transition to a stable state, e.g. the outputted signals being transitioned so as to be monaural signals that are identical signals in the left and the right, is necessary.

Figure 5:
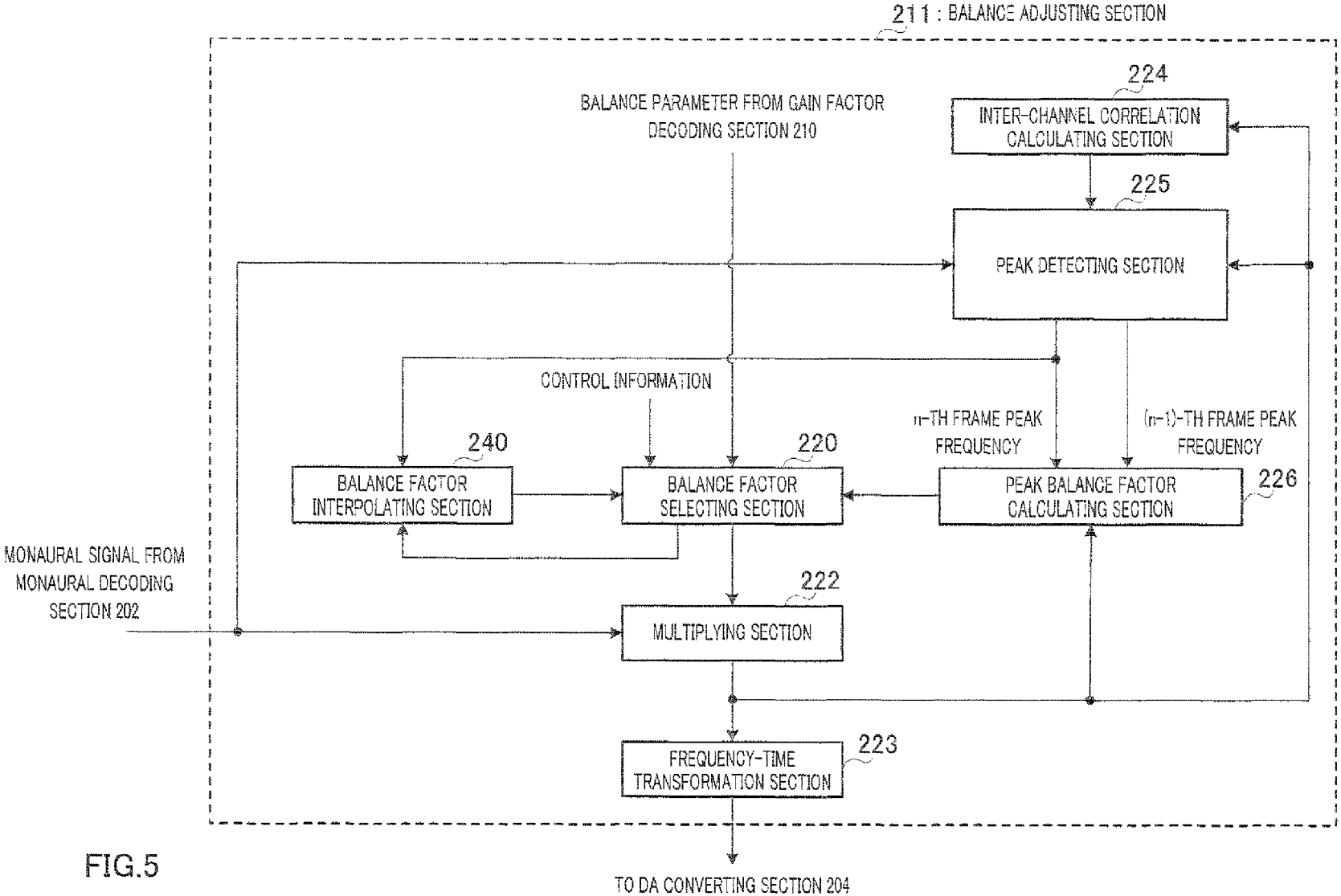
FIG. 5 is a block diagram of an internal configuration of a balance adjusting section of embodiment 2 of the present invention.

FIG. 5 is a block diagram of an internal configuration of balance adjusting section 211 of embodiment 2 of the present invention. It should be noted that a point in which FIG. 5 differs from FIG. 3 is that balance factor storing section 221 is changed to balance factor interpolating section 240. In FIG. 5, balance factor interpolating section 240 stores balance parameters outputted from balance factor selecting section 220, interpolates between the stored balance parameters (balance parameter of the past) and balance parameters to be the target based on an n-th frame peak frequency outputted from peak detecting section 225, and outputs the interpolated balance parameters to balance factor selecting section 220. Note that the interpolation is controlled adaptively according to a number of the n-th frame peak frequency.

Figure 6:
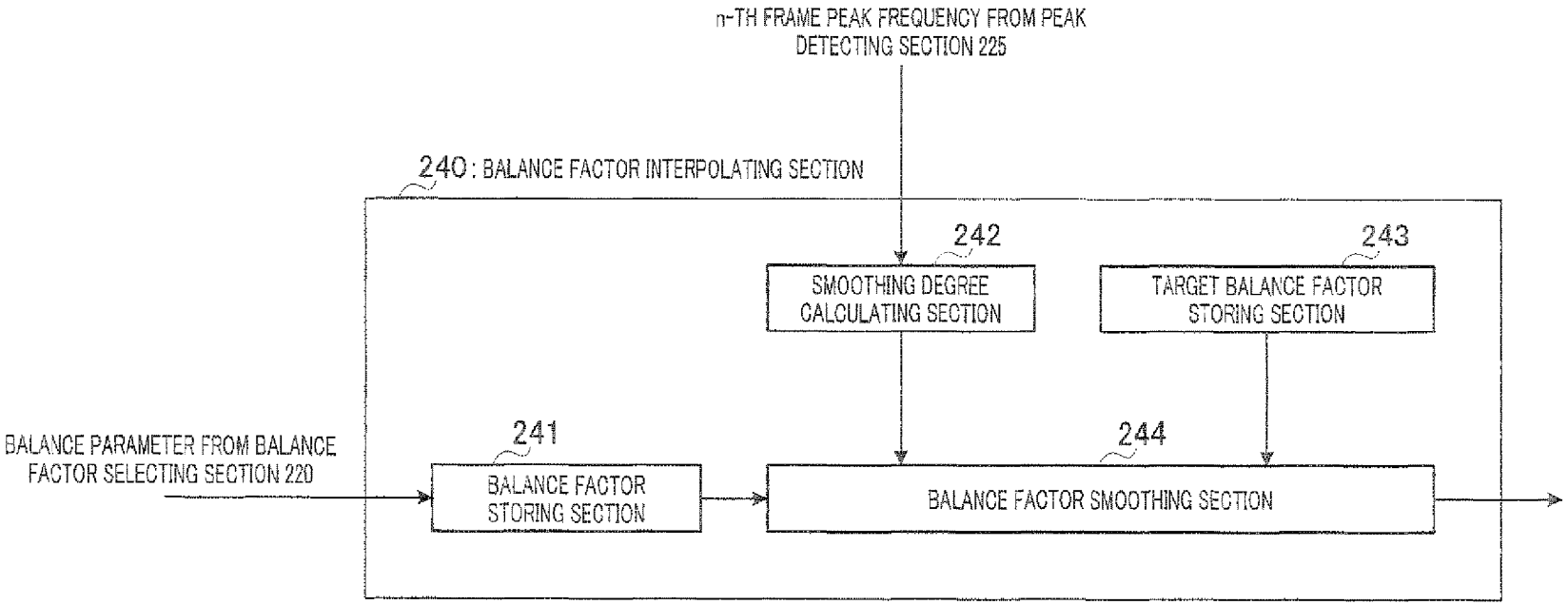
FIG. 6 is a block diagram of an internal configuration of a balance factor interpolating section shown in FIG. 5.

FIG. 6 is a block diagram of an internal configuration of balance factor interpolating section 240 shown in FIG. 5. As shown in FIG. 6, balance factor interpolating section 240 comprises balance factor storing section 241, smoothing degree calculating section 242, target balance factor storing section 243, and balance factor smoothing section 244.

Balance factor storing section 241 stores, for each of the frames, the balance parameters outputted from balance factor selecting section 220, and outputs the stored balance parameters (balance parameters of the past) at a timing of processing a subsequent frame to balance factor smoothing section 244.

Smoothing degree calculating section 242 calculates a smoothing factor μ that controls the interpolation of the balance parameters of the past and the target balance parameter in accordance with a number of n-th frame peak frequency outputted from peak detecting section 225, and outputs the calculated smoothing factor μ to balance factor smoothing section 244. Here, the smoothing factor μ is a parameter indicating a transition speed to a balance parameter that is to be the target from the balance parameter of the past. If this μ is large, it is assumed to represent that the transition is moderate, and if the μ is small, it is assumed to represent that the transition is rapid. An example of a method for deciding the μ is shown below. When the balance parameters are encoded for each of the sub-bands, a control is performed based on the number of the n-th frame peak frequency included in that sub-band.

When there is zero *n-th* frame peak frequency in a sub-band: $\mu=0.25$

When there is one *n-th* frame peak frequency in the sub-band: $\mu=0.125$

When there is a plurality of *n-th* frame peak frequencies in the sub-band: $\mu=0.0625$ (3)

Target balance factor storing section 243 stores the target balance parameters to be set in the case of long-period loss, and outputs the target balance parameters to balance factor smoothing section 244. Note that in the present embodiment, the target balance parameters are predetermined balance parameters. For example, as the target balance parameter, a balance parameter that will be a monaural output may be exemplified.

Balance factor smoothing section 244 performs the interpolation between the balance parameters of the past outputted from balance factor storing section 241 and the target balance parameters outputted from target balance factor storing section 243 by using the smoothing factor μ outputted from smoothing degree calculating section 242, and outputs balance parameters that are obtained as a result of the above to balance factor selecting section 220. An example of the interpolation using a smoothing factor will be given below.

$$WL(i)=pWL(i)\times\mu+TWL(i)\times(1.0-\mu)$$

$$WR(i)=pWR(i)\times\mu+TWR(i)\times(1.0-\mu) \quad (4)$$

Here, WL(i) represents a balance parameter on the left in frequency i, and WR(i) represents a balance parameter on the right in the frequency i. TWL(i) and TWR(i) represent target balance parameter on the left and right of the frequency i respectively. Note that, when the target balance parameters are numeral values meaning monaural conversion, then TWL (i)=TWR(i).

As is clear from the above equation 4, an influence of the balance parameters of the past is larger as the μ is larger, and balance factor interpolating section 240 outputs the balance parameters so as to slowly approach the balance parameters that are to be the target. Here, if the loss of the stereo encoded data continues, the output signals are to be subjected to the monaural conversion.

Accordingly, balance factor interpolating section 240 can realize a natural transition from the balance parameters of the past to the target balance parameter, especially in the long period loss of the stereo encoded data. This transition focuses on the frequency components having high temporal correlation, and a natural transition from stereo to monaural can be realized by moderately transitioning the balance parameters in the range having the frequency components with high correlation and rapidly transitioning the balance parameters in ranges other than the aforementioned.

According to embodiment 2, a focusing is made to the frequency components having high temporal correlation, and a natural transition from the balance parameters of the past to the target balance parameters can be realized by moderately transitioning the balance parameters in the range having the frequency components with high correlation to the target balance parameter and rapidly transitioning the balance parameters in ranges other than the aforementioned to the target balance parameters, even when the stereo encoded data is lost over a long period.

Embodiment 3

When stereo encoded data is received after stereo encoded data is lost over a long period or is lost very often, if an immediate switch to balance parameters decoded by gain factor decoding section 210 is made in balance adjusting section 211, a sense of discomfort may be generated in the switching from monaural to stereo, and a deterioration in an acoustic perception may accompany. Therefore, the transition from balance parameters that had been concealed upon the loss of the stereo encoded data to the balance parameters decoded by gain factor decoding section 210 must be made over time.

Figure 7:
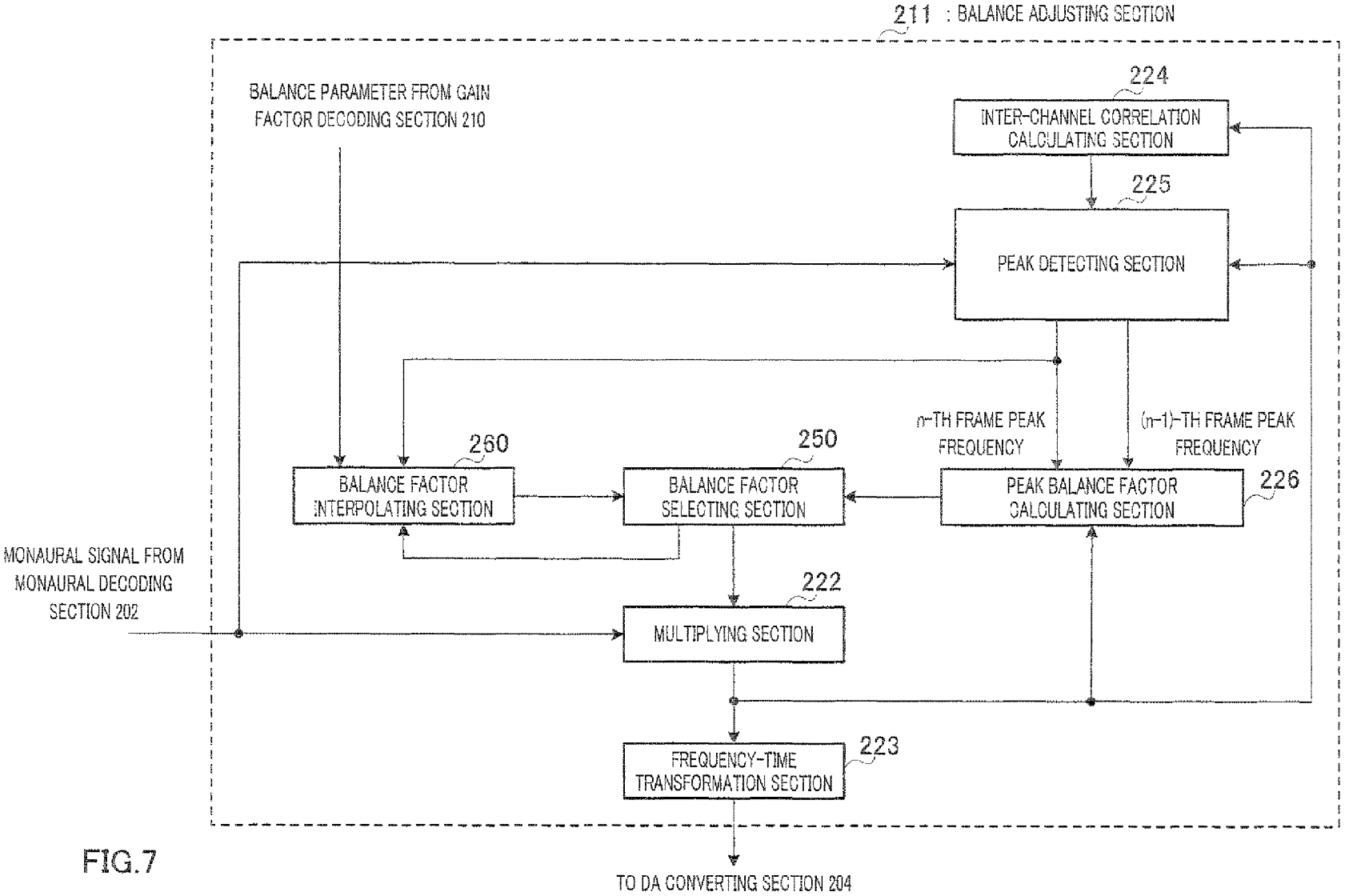
FIG. 7 is a block diagram of an internal configuration of a balance adjusting section of embodiment 3 of the present invention.

FIG. 7 is a block diagram of an internal configuration of balance adjusting section 211 of embodiment 3 of the present invention. It should be noted that FIG. 7 and FIG. 5 respectively showing the balance adjusting section differ partly in their configurations. FIG. 7 and FIG. 5 differ in that balance factor selecting section 220 is changed to balance factor selecting section 250, and balance factor interpolating section 240 is changed to balance factor interpolating section 260. In FIG. 7, balance factor selecting section 250 has inputs of balance parameters from balance factor interpolating section 260 and balance parameters from peak balance factor calculating section 226, and switches a connection state of multiplying section 222 and one of balance factor interpolating section 260 and peak balance factor calculating section 226. Typically, balance factor interpolating section 260 and multiplying section 222 are connected, but when the peak balance parameters from peak balance factor calculating section 226 are to be inputted, peak balance factor calculating section 226 and multiplying section 222 are connected only for frequency components in which the peaks have been detected. Further, the balance parameters inputted from balance factor interpolating section 260 are output to balance factor interpolating section 260.

Balance factor interpolating section 260 stores the balance parameters outputted from balance factor selecting section 250, interpolates between the stored balance parameters of the past and the balance parameters to be the target based on balance parameters outputted from gain factor decoding section 210 and n-th frame peak frequency outputted from peak detecting section 225, and outputs the interpolated balance parameters to balance factor selecting section 250.

Figure 8:
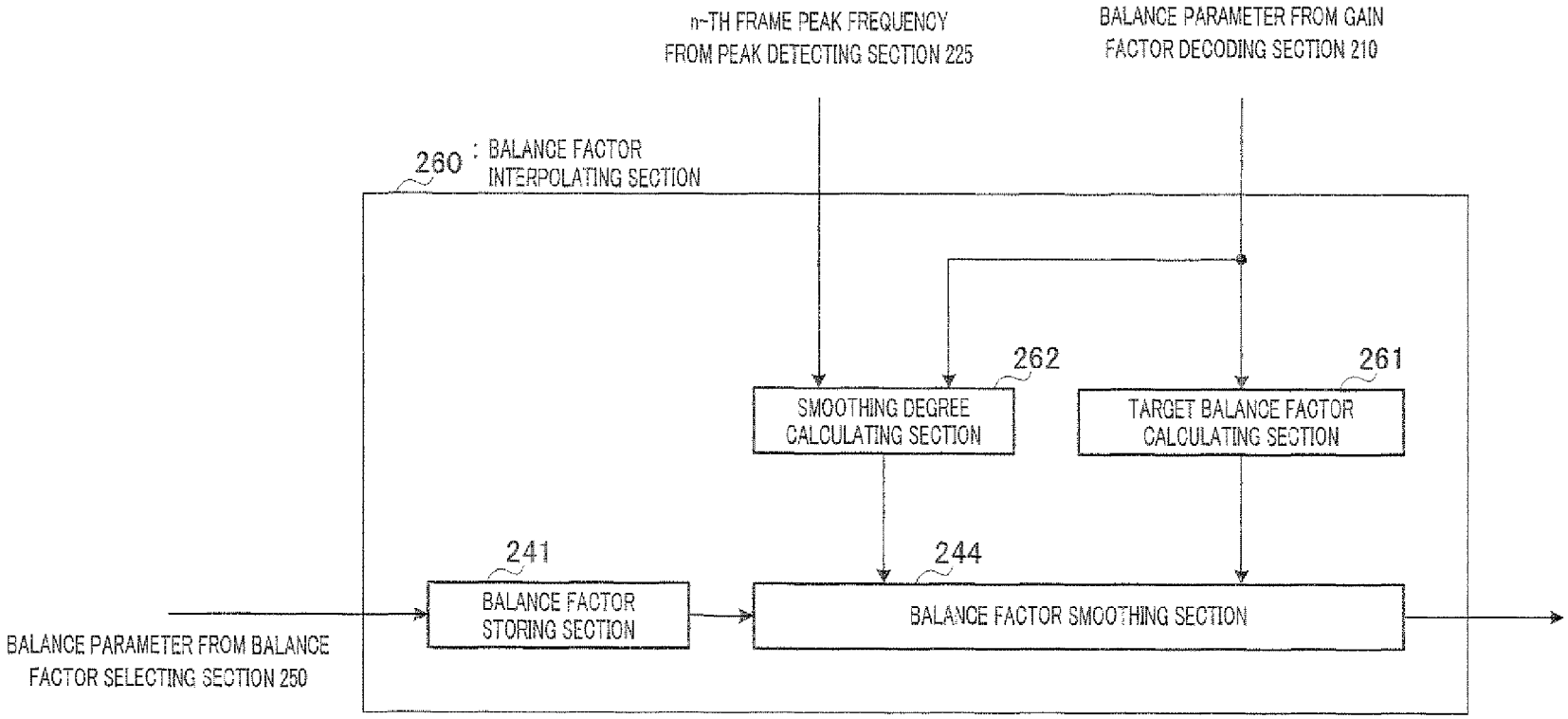
FIG. 8 is a block diagram of an internal configuration of a balance factor interpolating section shown in FIG. 7.

FIG. 8 is a block diagram of an internal configuration of balance factor interpolating section 260 shown in FIG. 7. It should be noted that FIG. 8 and FIG. 6 respectively showing the balance factor interpolating section differ partly in their configurations. FIG. 8 and FIG. 6 differ in that target balance factor storing section 243 is changed to target balance factor calculating section 261, and smoothing degree calculating section 242 is changed to smoothing degree calculating section 262.

When a balance parameter is outputted from gain factor decoding section 210, target balance factor calculating section 261 sets this balance parameter as the target balance parameter, and outputs the same to balance factor smoothing section 244. Further, when the balance parameters are not outputted from gain factor decoding section 210, predetermined balance parameters are set as the target balance parameters, and are outputted to balance factor smoothing section 244. Note that an example of the predetermined target balance parameter is a balance parameter meaning a monaural output.

Smoothing degree calculating section 262 calculates a smoothing factor based on the n-th frame peak frequency outputted from peak detecting section 225 and the balance parameters outputted from gain factor decoding section 210, and outputs the calculated smoothing factor to balance factor smoothing section 244. Specifically, when the balance parameters are not outputted from gain factor decoding section 210, i.e., when the stereo encoded data is lost, smoothing degree calculating section 262 performs operations similar to smoothing calculating section 242 as explained in embodiment 2.

On the other hand, when the balance parameters are outputted from gain factor decoding section 210, two patterns of processes may be used in smoothing degree calculating section 262. One is a process when the balance parameters are not influenced by the loss in the past from gain factor decoding section 210, and another is a process when the balance parameters outputted from gain factor decoding section 210 are influenced by the loss in the past.

When the balance parameters are not influenced by the loss in the past, the balance parameters outputted from gain factor decoding section 210 may be used and the balance parameters of the past may not be used, so the smoothing factor is made to be zero and outputted.

Further, the case where the balance parameters are influenced by the loss in the past, an interpolation to transition from the balance parameters of the past to the target balance parameters (here, the balance parameters outputted from gain factor decoding section 210) is necessary. At this occasion, the smoothing factor may be decided similar to the case in which the balance parameters are not outputted from gain factor decoding section 210, or the smoothing factor may be adjusted in accordance with a magnitude of the influence of the loss.

Note that, the magnitude of the influence of the loss can be estimated from a degree of loss of the stereo encoded data (number of successive losses or frequency thereof). For example, in the case of a long-period loss, it is assumed that decoded sound is converted to monaural. Thereafter, even if the stereo encoded data is received and decoded balance parameters are obtained, it is not preferable to use those parameters as they are. This is due to a risk of causing noise or discomfort perception by suddenly changing monaural sound to stereo sound. On the other hand, when the loss of the stereo encoded data is only by one frame, it is considered that there would be a small problem as a matter of the acoustic perception in using the decoded balance parameters as they are in a subsequent frame. Accordingly, it is useful to control the interpolation of the balance parameters of the past and the decoded balance parameters in accordance with the degree of loss of the stereo encoded data. Further, aside from the degree of loss, in cases in which stereo encoding is performed in a manner depending on a value of the past, there are cases in which a consideration should better be given not only in the viewpoint of the acoustic perception but also to an influence of a propagation of error remaining in the decoded balance parameter. In such occasion, there may be a case where a consideration such as continuing the smoothing to a degree by which the propagation of the error can be ignored is necessary. That is, an adjustment may be made such that when the influence of the loss in the past is severe, the smoothing factor is made to be larger, and when the influence of the loss in the past is trivial, the smoothing factor is made to be smaller.

Here, a determination on whether or not the influence of the loss in the past remains in the stereo encoded data will be explained. As the easiest method, there is a method of determining that the influence remains among a predetermined number of frames from a previously lost frame. Further, there also is a method of determining whether or not the influence of the loss remains from absolute values and changes of energy of the monaural signal and the left and right channels. Further, there is a method of determining whether or not the influence of the loss in the past remains by using a counter.

In this method using the counter, counter C has 0 representing a stable state as its initial value, and counts using whole numbers. When the balance parameters are not outputted, counter C increases by 2, and when the balance parameters are outputted, counter C decreases by 1. That is, it can be determined that the larger the value of counter C, the greater the influence of the loss in the past is. For example, when the balance parameters are not outputted for three frames in succession, counter C will be 6; thus it can be determined that the influence of the loss in the past remains until the balance parameters are outputted six frames in succession.

Accordingly, since balance factor interpolating section 260 can calculate the smoothing factor by using the n-th frame peak frequency and the balance parameters, and control the transition speed from stereo to monaural at the time of the long-period loss and the transition speed from monaural to stereo at the time of receiving the stereo encoded data after the loss, these transitions can be performed smoothly. These transitions focus on the frequency components having high temporal correlation, and natural transitions can be realized by moderately transitioning the balance parameters in the range having the frequency components with high correlation and rapidly transitioning the balance parameters in ranges other than the aforementioned.

According to embodiment 3, a focusing is made to the frequency components having high temporal correlation, and a natural transition from the balance parameters of the past to the target balance parameter can be realized by moderately transitioning the balance parameters in the range having the frequency components with high correlation to the target balance parameter and rapidly transitioning the balance parameters in ranges other than the aforementioned to the target balance parameter, even when the stereo encoded data is lost over a long period. Further, the natural transitions of the balance parameters can be realized even when reception of the stereo encoded data that had been lost over a long period becomes enabled.

According to the above, the embodiments of the present invention had been explained.

Note that, in the respective embodiments as above, although the left channel and the right channel had been denoted respectively as L channel and R channel, no limitation is made hereto, and they may be opposite.

Further, although predetermined threshold values βM, βL, βR had respectively been presented for monaural peak detecting section 230, L channel peak detecting section 231 and R channel peak detecting section 232, these may be decided adaptively. For example, the thresholds may be decided to limit the number of peaks to be detected or to be at a fixed ratio of a value of the maximum amplitude, or the threshold values may be calculated from energy. Further, in the exemplified methods, although the peak is detected in identical method over all of the ranges, the threshold values and the processes may be changed for each of the ranges. Further, although the explanations had been given using examples of monaural peak detecting section 230, L channel peak detecting section 231 and R channel peak detecting section 232 calculating the peak independently for each of the channels, a detection may be made such that the peak components to be detected do not overlap between L channel peak detecting section 231 and R channel peak detecting section 232. Monaural peak detecting section 230 may perform peak detection only in the vicinity of the peak frequencies detected by L channel peak detecting section 231 and R channel peak detecting section 232. Further, L channel peak detecting section 231 and R channel peak detecting section 232 may perform peak detection only in the vicinity of the peak frequency detected by monaural peak detecting section 230.

Further, in monaural peak detecting section 230, L channel peak detecting section 231, and R channel peak detecting section 232, although an explanation had been given in a configuration in which the peaks are detected respectively, the peak detection may be performed in cooperation for a reduction of a processing amount. For example, the peak information detected by monaural peak detecting section 230 is inputted to L channel peak detecting section 231 and R channel peak detecting section 232. In L channel peak detecting section 231 and R channel peak detecting section 232, the peak detection may be performed with the vicinity of the inputted peak component as the object. Of course, an opposite combination thereof may be used.

Further, although γ had been a predetermined constant in peak selecting section 233, it may be decided adaptively. For example, γ may be larger for lower frequency side, and γ may be larger for larger amplitude. Further, γ may be a different value on the high frequency side and the low frequency side, and a range thereof may be asymmetric.

Further, in peak selecting section 233, when the peak components of both the L and R channels are very close (including a case of overlapping), both peaks may be excluded because of the difficulty in determining that energy biased in the left and right exists.

Further, upon explaining the operation of peak trace section 234, although an explanation in which all of the peak components of the monaural signal are checked in order had been given, the selected peak information may be checked in order. Further, although η had been a predetermined constant, it may be decided adaptively. For example, η may be larger for the lower frequency side, and η may be larger for the larger amplitude. Further, η may be a different value on the high frequency side and the low frequency side, and a range thereof may be asymmetric.

Further, in peak trace section 234, although a peak having a high temporal continuity had been detected in the peak components of both the L and R channels of one frame of the past and the peak components of the monaural signal of the present frame, peak components of a frame of yet further past may be used.

Further, in peak balance factor calculating section 226, although an explanation had been given with a configuration in which the peak balance parameters are calculated from the frequency signals of both the L and R channels of the (n−1)-th frame, a calculation may be made by using other information so as to use the monaural signal of the (n−1)-th frame in combination.

Further, in peak balance factor calculating section 226, although the range having frequency j as the center had been used in calculating the balance parameter of frequency i, frequency j does not necessarily need to be the center. For example, the range may be a range including frequency j and having frequency i as the center.

Further, although balance factor storing section 221 had been configured to store the balance parameters of the past and output the same as they are, the balance parameters of the past that are smoothed or averaged in the frequency axis direction may be used. The balance parameter may be calculated directly from the frequency components of both the L and R channels so as to be at an average in the frequency band.

Note that, in target balance factor storing section 243 of embodiment 2 and target balance factor calculating section 261 of embodiment 3, although values meaning monaural conversion are exemplified as the predetermined balance parameters, the present invention is not limited to these. For example, the output may be made only to one of the channels, and the value may be as appropriate for a purpose thereof. Further, although predetermined constants had been used to simplify the explanation, the decision may be made dynamically. For example, a balance ratio of the energy of the left and right channels may be smoothed for long period, and the target balance parameters may be decided subjective to the ratio. Accordingly, by dynamically calculating the target balance parameter, even more natural concealment may be expected when the biasing of the energy between the channels is continuous and stable.

Also, although cases have been described with the above embodiment as examples where the present invention is configured by hardware, the present invention can also be realized by software.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2009-004840, filed on Jan. 13, 2009, and Japanese Patent Application No. 2009-076752, filed on Mar. 26, 2009, including the specifications, drawings, and abstracts are incorporated herein by reference in their entirety.

INDUSTRIAL APPLICABILITY

The present invention is suitable for use in a audio signal decoding apparatus that decodes encoded audio signals.

The invention claimed is:

1. An audio signal decoding apparatus comprising:

a peak detecting section that, when a peak frequency component existing in one of a left channel and a right channel of a previous frame and a peak frequency component of a monaural signal of a present frame are in a matching range, extracts a set of a frequency of the peak frequency component of the previous frame and a frequency of a peak frequency component of the monaural signal of the present frame corresponding to that frequency;

a peak balance factor calculating section that calculates, from the peak frequency component of the previous frame, a balance parameter for stereo-converting the peak frequency component of the monaural signal; and a multiplying section that multiplies the peak frequency component of the monaural signal of the present frame by the calculated balance parameter to perform stereo conversion.

2. The audio signal decoding apparatus according to claim 1, further comprising a balance factor interpolating section that, based on the number of peak frequency components of the monaural signal of the present frame, controls a transition speed from a past balance parameter to a target balance parameter, interpolates between the past balance parameter and the target balance parameter, and obtains a balance parameter.

3. The audio signal decoding apparatus according to claim 2, wherein the balance factor interpolating section controls the transition speed to be faster when the number of peak frequency components of the monaural signal of the present frame is larger or controls the transition speed to be slower when the number of peak frequency components of the monaural signal of the present frame is smaller.

4. The audio signal decoding apparatus according to claim 2, wherein, when stereo encoded data has been lost, the balance factor interpolating section controls the transition speed in accordance with a magnitude of an influence of a past loss.

5. A method of adjusting a balance comprising:

a peak detecting step of extracting, when a peak frequency component existing in one of a left channel and a right channel of a previous frame and a peak frequency component of a monaural signal of a present frame are in a matching range, a set of a frequency of the peak frequency component of the previous frame and a frequency of a peak frequency component of the monaural signal of the present frame corresponding to that frequency;

a peak balance factor calculating step of calculating, from the peak frequency component of the previous frame, a balance parameter for stereo-converting the peak frequency component of the monaural signal; and a multiplying step of multiplying the peak frequency component of the monaural signal of the present frame by the calculated balance parameter to perform stereo conversion.

* * * * *